US009578715B2

(12) United States Patent
Duan

(10) Patent No.: US 9,578,715 B2
(45) Date of Patent: Feb. 21, 2017

(54) METHOD AND SYSTEM FOR DRIVING LED LAMP

(71) Applicants: BOE TECHOLOGY GROUP CO., LTD., Beijing (CN); BEIJING BOE DISPLAY TECHNOLOGY CO., LTD., Beijing (CN)

(72) Inventor: Xin Duan, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 210 days.

(21) Appl. No.: 14/389,076

(22) PCT Filed: Dec. 20, 2013

(86) PCT No.: PCT/CN2013/090067

§ 371 (c)(1),
(2) Date: Sep. 29, 2014

(87) PCT Pub. No.: WO2014/176920

PCT Pub. Date: Nov. 6, 2014

(65) Prior Publication Data

US 2016/0242257 A1 Aug. 18, 2016

(30) Foreign Application Priority Data

Apr. 28, 2013 (CN) ..... 2013 1 0156709

(51) Int. Cl.
*H05B 37/02* (2006.01)
*H05B 33/08* (2006.01)

(52) U.S. Cl.
CPC ..... *H05B 33/0884* (2013.01); *H05B 33/0815* (2013.01); *H05B 33/0827* (2013.01); *H05B 33/0842* (2013.01); *H05B 33/0893* (2013.01)

(58) Field of Classification Search
CPC ..... H05B 33/08
(Continued)

(56) References Cited

U.S. PATENT DOCUMENTS 8,242,716 B2 8/2012 Je et al.
8,339,070 B2 * 12/2012 Lai ..... H05B 33/0809 315/224

(Continued)

FOREIGN PATENT DOCUMENTS

CN 101835299 A 9/2010
CN 102005191 A 4/2011

(Continued)

OTHER PUBLICATIONS

CN Application No. 2013101567096 Office Action dated Aug. 22, 2014, including English Translation.

(Continued)

*Primary Examiner* — Thuy Vinh Tran
(74) *Attorney, Agent, or Firm* — Banner & Witcoff, Ltd.

(57) ABSTRACT

Embodiments of the disclosure include an LED lamp driving method and a system in the liquid crystal panel display field. A method of the disclosure includes: adjusting correspondence relations between ports of the LED lamp and channel ports of the LED lamp driving chip first; and then connecting ports of the LED lamp and channel ports of the LED lamp driving chip according to the adjusted the correspondence relations to control light emission of the LED lamp. Aspects of the disclosure include avoiding overheating and even burning of LED lamp driving chips; can be adapted to various LED lamps operation to reduce failure rate of LED lamp operation to the minimum; effectively reduces concentrated heating of the LED lamp driving chip and increases service life of the LED lamp driving chip.

13 Claims, 3 Drawing Sheets

(58) Field of Classification Search
USPC ..... 315/185 R, 209 R, 291, 360; 345/102
See application file for complete search history.

(56) References Cited

U.S. PATENT DOCUMENTS

| | | | | |
|---|---|---|---|---|
| 8,344,653 | B2 * | 1/2013 | Lee | H05B 33/0815 315/225 |
| 8,456,098 | B2 * | 6/2013 | Peting | H05B 37/0245 315/185 R |
| 8,492,982 | B2 | 7/2013 | Hagino et al. | |
| 2011/0050131 | A1 | 3/2011 | Je et al. | |
| 2011/0279043 | A1 | 11/2011 | Hagino et al. | |
| 2012/0207205 | A1 * | 8/2012 | Zhao | H05B 33/0827 375/238 |

FOREIGN PATENT DOCUMENTS

| | | | |
|---|---|---|---|
| CN | 102186288 | A | 9/2011 |
| CN | 102223743 | A | 10/2011 |
| CN | 102237040 | A | 11/2011 |
| CN | 202172510 | U | 3/2012 |
| CN | 103220867 | A | 7/2013 |

OTHER PUBLICATIONS

Nov. 3, 2015—International Preliminary Report on Patentability Appn PCT/CN2013/090067.
International Search Report mailed Mar. 27, 2014 (PCT/CN2013/090067); ISA/CN.

* cited by examiner

--Prior Art--

METHOD AND SYSTEM FOR DRIVING LED LAMP

The application is a U.S. National Phase Entry of International Application No. PCT/CN2013/090067, filed on Dec. 20, 2013, designating the United States of America and claiming priority to Chinese Patent Application No. 201310156709.6, filed on Apr. 28, 2013. The present application claims priority to and the benefit of all the above-identified applications and all of the above-identified applications are incorporated by reference herein in their entireties.

FIELD OF THE INVENTION

Embodiments of the present invention relate to a liquid crystal panel display, and particularly to a driving method and system for an LED lamp.

BACKGROUND

Liquid crystal panels can not emit light by themselves, and thus they need to be used with backlight sources. Most products in the market use LED backlights since LED backlights have advantages of, such as, light weight, small thickness and low power dissipation. In a large size liquid crystal panel, there are many LED lamps and the drive currents thereof will be large, and therefore driving voltage differences among a plurality strings of LED lamps will be large. FIG. 1 is a schematic diagram of prior art driving method of an LED lamp. In a traditional LED driving mode, for a positive driving voltage, a driving voltage with the largest voltage drop among the plurality strings of LED lamps is selected as a driving voltage for the entire backlight assembly, and thus for LED lamp strips with small voltage drops, remaining voltage will be completely applied on LED driving chips. At the same time, since LED driving currents for large size panels are generally large, when a voltage difference is applied to an LED driving chip, the chip may be burnt due to large amount of heat.

For the voltage differences among the LED lamp strips, theoretically, the smaller the voltage differences are, the smaller the heat generated by the LED driving chips will be. However, in practice, it is difficult to control the voltage differences between the lamp strips, and at the same time, distinguishing process may cause cost increase.

SUMMARY

I. Technical Problem

The embodiments of the present invention is directed to provide a driving method and system for LED lamps, to avoid overheating or burning of LED lamp driving chips in the display process of prior art LED lamps.

II. Technical Solution

In order to solve the above-mentioned problem, the embodiments of the present invention provide an LED lamp driving method including following steps:

S1: adjusting correspondence relations between ports of the LED lamps and channel ports of the LED lamp driving chips;

S2: connecting the ports of the LED lamps and the channel ports of the LED lamp driving chips according to the adjusted correspondence relations, and controlling the LED lamps to emit light.

The step S1 further includes: modifying the number of the ports of the LED lamps and the number of the channel ports of the LED lamp driving chips in the correspondence relations according to an external trigger signal or a setting method.

The method further comprises, prior to the abovesaid step S1:

S0: determining whether a maximum load of the LED lamp driving chip has reached a safety threshold;

wherein, the step S1 further includes adjusting the correspondence relations between the ports of the LED lamps and the channel ports of the LED lamp driving chips when the maximum load of the LED lamp driving chips reaches the safety threshold.

The safety threshold is a sum of a forward conduction voltage of LEDs connected in series and a floating voltage in a channel.

The value of the floating voltage is, for example, 3V.

Step S1 further includes: automatically adjusting the correspondence relations between the ports of the LED lamps and the channel ports of the LED lamp driving chips for every one clock period.

A method for adjusting the correspondence relations between the ports of the LED lamps and the channel ports of the LED lamp driving chips may be, for example, a shifting cycling method.

An LED lamp driving system includes a plurality strings of LED lamps and at least one LED lamp driving chip, wherein the system further comprises a driving controller for controlling the correspondence relations between the ports of the LED lamps and the ports of the LED lamp driving chip, wherein the LED lamps are connected to the driving controller and the driving controller is connected to the LED lamp driving chip.

The driving controller comprises:

a signal generator;

a signal controller for adjusting the correspondence relations according to signals from the signal generator;

a memory for saving the correspondence relations;

a switch controller for controlling the correspondence relations between the ports of the LED lamps and the ports of the LED lamp driving chip according to signals from the signal controller; and a power supply;

wherein the signal controller is connected with the signal generator, the memory and the switch controller, respectively; and the power supply supplies power for the signal generator, the signal controller, the memory and the switch controller.

The signal generator is, for example, a crystal oscillator or a timer counter.

The switch controller is, for example, a MOS circuit or a switching circuit.

III. Beneficial Effects

Embodiments of the present invention possess advantages as follows.

1. The correspondence relations between the ports of the LED lamp and the ports of the LED lamp driving chips can be modified by the driving controller to apply the voltage applied on the LED lamp driving chips onto individual ports of the chip circularly, hence avoiding overheating and even burning of LED lamp driving chip resulted from long time application of a high voltage on a certain fixed port of the LED lamp driving chip.

2. The method for the driving controller to control the correspondence relations between the ports of the LED lamps and the ports of the LED lamp driving chip may be changed as required and adapted to various LED lamps operations, thereby reducing the failure rate of the operation of LED lamps to the minimum.

3. The time at which the driving controller controls convertion between the ports of the LED lamp and ports of the LED lamp driving chip is adjustable, hence effectively reducing concentrated heating of the LED lamp driving chip and increasing service life of the LED lamp driving chip.

BRIEF DESCRIPTION OF DRAWINGS

In order to clearly illustrate the technical solution of the embodiments of the invention, the drawings of the embodiments will be briefly described in the following. It is obvious that the described drawings are only related to some embodiments of the invention and thus are not limitative of the invention.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms such as "a," "an," etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In order to avoid overheating or burning of an LED lamp driving chip during the display process of LED lamp, embodiments of the present invention provide a driving method and system for LED lamps.

Figure 1:
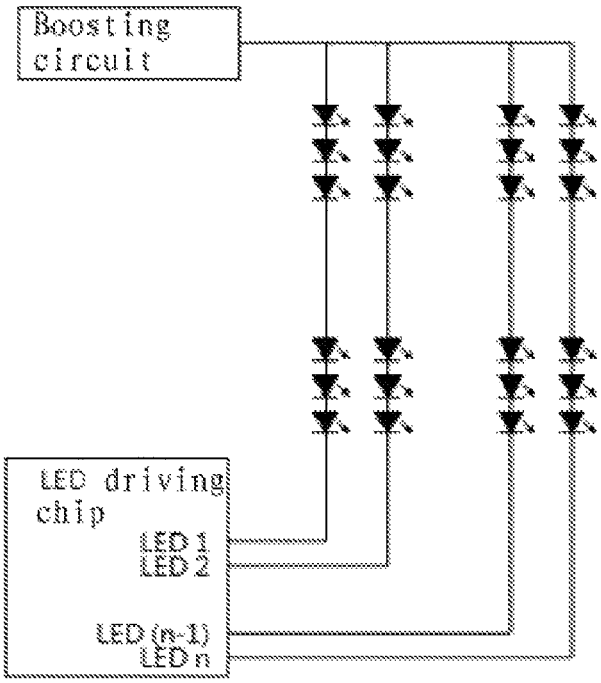
FIG. 1 is a schematic diagram of prior art driving device for LED lamps.
Figure 2:
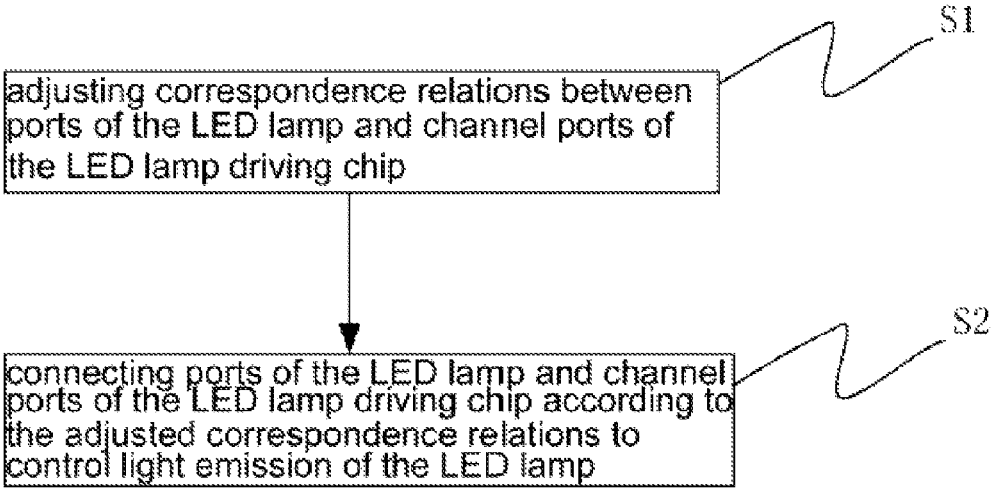
FIG. 2 is a flow chart of an LED lamp driving method provided in an embodiment of the present invention.

As shown in FIG. 2, the LED lamp driving method provided in an embodiment of the present invention includes steps as follows.

Step S1: adjusting the correspondence relations between the ports of the LED lamp and the channel ports of the LED lamp driving chip.

The correspondence relations herein means the driving relationship of one to one correspondence between the ports of the LED lamp and the ports of the LED lamp driving chip. In practical operations, the numbering of the ports of the LED lamps and the numbering of the channel ports of LED lamp driving chip in the correspondence relations may be modified according to an external trigger signal or a preset method.

For example, 1) The way to modify the numbering of the ports of the LED lamps and the numbering of the channel ports of the LED lamp driving chip in the correspondence relations according to an external trigger signal may include the following steps:

adding step S0 before step S1: determining whether the maximum load of the LED lamp driving chip reaches a safety threshold.

The safety threshold of the driving chip depends on the maximum voltage that the MOSs in the chip can bear. The safety threshold should be set smaller than the maximum voltage the MOS can bear. Generally, the safety threshold may be set to be the sum of voltage drops of all LED lamps connected in series in this channel plus a certain floating voltage, wherein the floating voltage is generally set to, e.g., 3V.

Now, step S1 is: adjusting the correspondence relations between the ports of LED lamp and the channel ports of the LED lamp driving chip when the maximum load of the LED lamp driving chip reaches the safety threshold.

2) The way to modify the numbering of the ports of the LED lamps and the numbering of the channel ports of the LED lamp driving chip in the correspondence relations according to preset method may be performed as follows.

The correspondence relations between the ports of the LED lamps and the channel ports of the LED lamp driving chip may be automatically adjusted for every one clock period.

The above-mentioned clock period may be, but not limited to, 1 minute, 10 minute or half an hour and etc. The clock period may be set according to the type of the driving chip.

After the above-mentioned LED lamps and the LED lamp driving chip are powered on, the correspondence relations between the ports of the LED lamps and the channel ports of the LED lamp driving chip is recorded and stored. The correspondence relations is stored in a memory.

There are various methods for modifying the above-mentioned correspondence relations, which will be explained hereinafter, with the shifting cycle method as an example.

The correspondence relations between the ports of the LED lamps and the channel ports of the LED lamp driving chip may be established by shifting one in turn for every clock period.

For example, in the correspondence relations between the ports of the LED lamps and the channel ports of the LED lamp driving chip, a port numbered i of an LED lamp corresponds to a channel port numbered i of the LED lamp driving chip initially. After one clock period, the port numbered i of the LED lamp corresponds to a channel port numbered i+1 of the LED lamp driving chip, that is, the expression for the correspondence relations between the ports of the LED lamps and the channel ports of the LED lamp driving chip is:

$$I(i) \leftrightarrow O(j),\ 1 \le i \le M,\ 1 \le j \le M$$

wherein:

I is a port of an LED lamp;

i is a number of the port of the LED lamp;

O is a channel port of the LED lamp driving chip;

is the number of a channel port of the LED lamp driving chip;

M is a total number of the ports of LED lamps or the channel ports of the LED lamp driving chip.

Initially, that is, when the LED lamps and the LED lamp driving chip are powered on, that is, i=j. In the above-mentioned formulae, after every one clock signal or other control signal, the value of j increases by one, taking a value cyclely in turn from small to large from 1 to M.

Step S2: connecting the ports of the LED lamps and the channel ports of the LED lamp driving chip according to the adjusted correspondence relations to control light emission of the LED lamp.

In the process of modifying the correspondence relations, the ports of the LED lamps are fixed and energized all the time. What is modified are the channel port of the LED lamp driving chip that corresponds to a certain port of the LED lamps. In this way, normal light emission of the LED lamp can be ensured, and high temperature resulted from high voltage applied on the LED lamp driving chip among the channel ports of the LED lamp driving chip can be released cyclely, and thereby lengthening the service life of LED lamp driving chip and reducing failure rate of the operation of LED lamps.

An embodiment of the present invention further provides an LED lamp driving system for implementing the above-mentioned method.

The LED lamp driving system of the present embodiment includes a plurality strings of LED lamps, at least one LED lamp driving chip and a driving controller for controlling a correspondence relations between the ports of the LED lamps and the channel ports of the LED lamp driving chip. The driving control device controls one or more LED lamp driving chips at the same time.

The LED lamps are connected with the driving controller and the driving controller is connected with the LED lamp driving chip. The driving controller includes a signal generator, a signal controller for adjusting the correspondence relations according to the signal sent from the signal generator, a memory for storing the correspondence relations, a switch controller for controlling the correspondence relations between the ports of the LED lamps and the channel ports of the LED lamp driving chip according to the output signal of the signal controller and a power supply. The signal controller is connected with the signal generator, the memory and the switch controller, respectively. The power supply supplies power for the signal generator, the signal controller, the memory and the switch controller.

The signal generator may be a crystal oscillator or a timer counter. The signal generator may also be a device for sending signals according to a preset program. The signal controller is a cpu or a monolithic computer for reading and adjusting the correspondence relations.

The switch controller is a MOS circuit or a switching circuit, which allows the LED lamp to emit light normally, and at the same time, the high temperature resulted by high voltage applied on the LED lamp driving chip is released circularly among ports of the chip.

Figure 3:
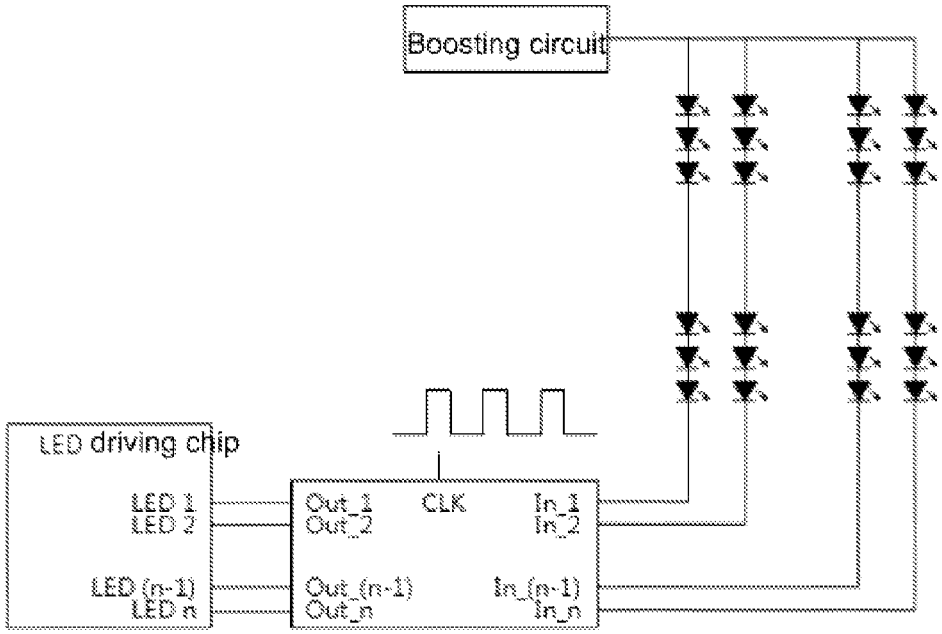
FIG. 3 is a schematic diagram of a driving device of LED lamps according to an embodiment of the present invention.

In embodiments of the present invention, a driving controller is added between the traditional LED driving chip and the LED lamp strips. As shown in FIG. 3, the switch controller of the driving controller mainly includes input ports (that is, ports connected to the LED lamps: Input_1, Input_2, . . . , Input_n), output ports (namely, ports connected to the LED lamp driving chip: Out_1, Out_2, . . . , Out_n) and a clock signal input CLK.

The driving controller mainly functions to modify the correspondence relations between input and output ports according to signals of the external signal generator. The embodiment of the present invention will be described below with respect to the case where the signal generator is a crystal oscillator.

TABLE 1

| | In_1 | In_2 | In_3 | In_4 | . . . | In_(n − 3) | In_(n − 2) | In_(n − 1) | In_n |
|---|---|---|---|---|---|---|---|---|---|
| T | LED 1 | LED 2 | LED 3 | LED 4 | . . . | LED (n − 3) | LED (n − 2) | LED (n − 1) | LED n |
| 2T | LED n | LED 1 | LED 2 | LED 3 | . . . | LED (n − 4) | LED (n − 3) | LED (n − 2) | LED (n − 1) |
| 3T | LED (n − 1) | LED n | LED 1 | LED 2 | . . . | LED (n − 5) | LED (n − 4) | LED (n − 3) | LED (n − 2) |
| . . . | . . . | . . . | . . . | . . . | . . . | . . . | . . . | . . . | . . . |
| (n − 1)T | LED 3 | LED 4 | LED 5 | LED 6 | . . . | LED (n − 1) | LED n | LED 1 | LED 2 |
| nT | LED 2 | LED 3 | LED 4 | LED 5 | . . . | LED (n − 2) | LED (n − 1) | LED n | LED 1 |
| (n + 1)T | LED 1 | LED 2 | LED 3 | LED 4 | . . . | LED (n − 3) | LED (n − 2) | LED (n − 1) | LED n |

As shown in Table 1, the first row in the table represents input ports of the driving controller; the first column of the table represents time, wherein T represents one clock period of the clock signal, the numbers in front of 'T' represent the numbering of the clock periods; the other elements in the table represent the correspondence relations between output ports and input ports at a certain moment.

In practical applications, the driving controller may be triggered in various ways. Other mapping approaches that can be used herein include, but not limited to, the mapping approaches listed in the table. Descriptions are provided with the approach shown in the table as an example, wherein time T represents a start state, and the input and output ports are in one to one correspondence. After the next clock pulse, i.e. at the time 2T, the input channels are shifted downwards, that is, the original input channel correspond to the next output channel.

With such a method, the power loss concentrated in a certain channel originally may be distributed to other output channels after one cycling period nT, thereby achieving the object of the present invention.

Figure 4:
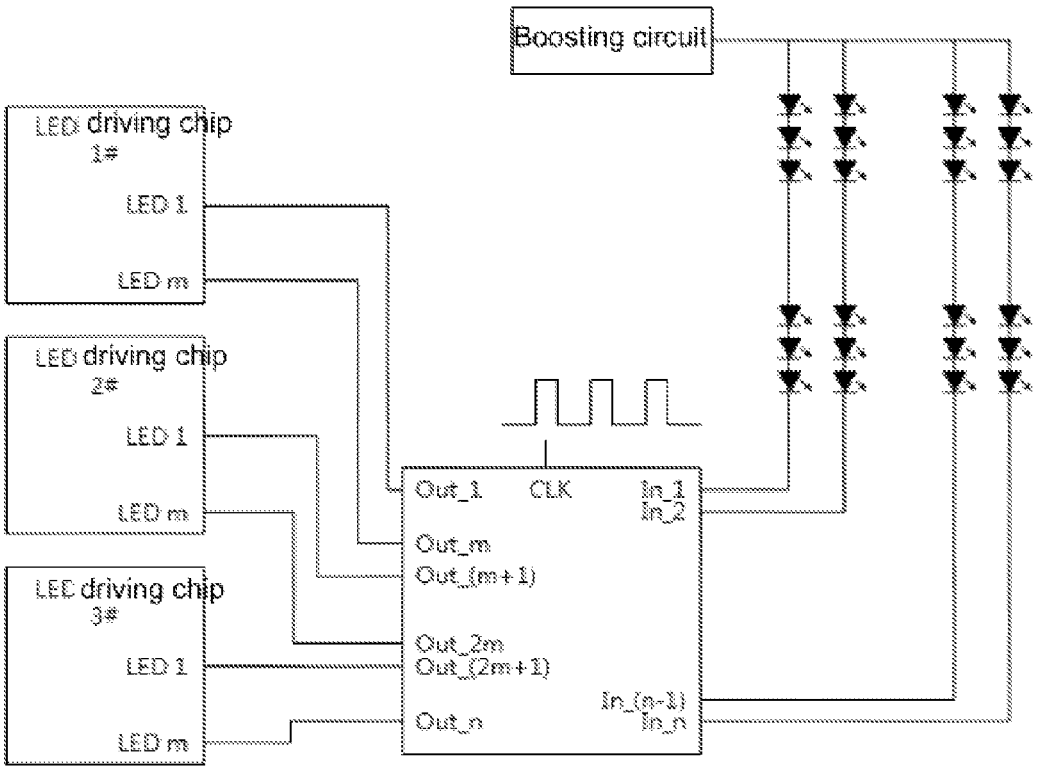
FIG. 4 is a schematic diagram of extended connection of LED driving mode according to an embodiment of the present invention.

This driving method can also apply to applications of multiple LED driving chips. As shown in FIG. 4, when the driving controller is connected to n inputs of LED lamps, three LED driving chips are required accordingly (as an example, each LED driving chip contains m ports, and n=3 m). After applying this driving approach, the power loss concentrated originally on one driving chip can be distributed onto other driving chips to a certain extent, hence effectively reducing heat generated by the one driving chip.

Figure 5:
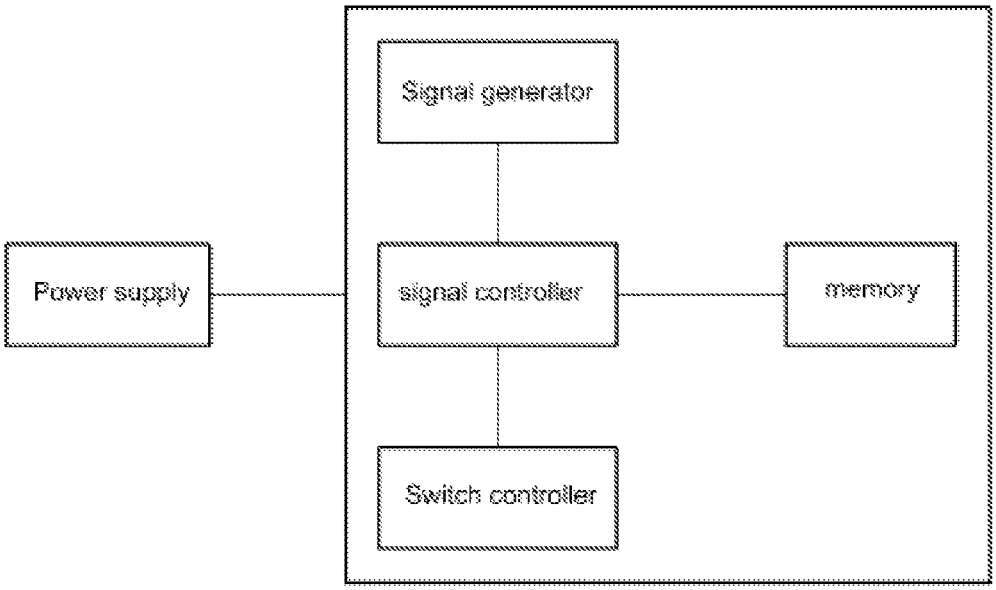
FIG. 5 is a diagram of a structure a driving controller.

FIG. 5 depicts a structure diagram of a driving controller, including at least two parts, that is, the signal controller and the switch controller. The signal controller is mainly configured to receive signals from the signal generator (external crystal oscillator or clock signals), retrieve the mapping relationship of I/O ports by looking up the table at different timings, transmit the control signal to the switch controller, and save the correspondence relation table of I/O ports in internal or external memories, for the signal controller to look up the table at different timings. The switch controller is configured to connect ports of the LED lamp and ports of the LED lamp driving chip, wherein the switch controller may be implemented by, for example, traditional MOS circuits or other switching circuits, of which details are omitted herein.

When the signal controller captures the clock pulse, the internal clock counter increases by 1, and at the same time, looked up the table in the memory according to the value of the counter to retrieve the correspondence relations between the ports of the LED lamps and the ports of the LED lamp driving chips at the current moment. After the signal controller retrieves the correspondence relations, it outputs a control signal that is identifiable by the switching controller to the switch controller that controls the turn-on of respective switches to conduct corresponding ports of the LED lamp and ports of the LED lamp driving chip.

Thus the effect of time-division mapping between the LED lamps and the LED driving chip is realized.

TABLE 2

| | In_1 | In_2 | . . . In_m | In_(m + 1) | In_(m + 2) | . . . In_2m |
|---|---|---|---|---|---|---|
| T | LED 1 | LED 2 | . . . LED m | LED (m + 1) | LED (m + 2) | . . . LED 2m |
| 2T | LED m | LED 1 | . . . LED (m − 1) | LED 2m | LED (m + 1) | . . . LED (2m − 1) |
| 3T | LED (m − 1) | LED m | . . . LED (m − 2) | LED (2m − 1) | LED 2m | . . . LED (2m − 2) |
| . . . | . . . | . . . | . . . . . | . . . | . . . | . . . . . |
| (m − 1)T | LED 3 | LED 4 | . . . LED 2 | LED (m + 3) | LED (m + 4) | . . . LED (m + 2) |
| mT | LED 2 | LED 3 | . . . LED 1 | LED (m + 2) | LED (m + 3) | . . . LED (m + 1) |

Table 2 shows a setting approach for multiple LED driving chips (with two LED driving chips as an example) on the original basis, wherein each LED driving chip corresponds to m channels, using one control circuit. Such a case may corresponds to an application of multiple LED driving chips. In this embodiment, it is set to perform shift cycling on a single LED driving chip. Of course, in case of a plurality of LED driving chips, it is also possible to perform shift cycling on all ports, which is not described in detail here.

This mapping relationship is not limitative. It is simply required to map the used I/O ports based on time according to practical requirements. Those skilled in the art can realize other illustrative mapping relationships according to the present disclosure, which will not be described in details here.

In the embodiments of the present invention, a driving controller is added between connections of traditional LED driving chip and LED lamps, with adjustments in time, it is possible to distribute heat concentrated on a certain output channel of the chip to other output channels, thereby reducing heat concentrated on the certain output channel and increasing the maximum power loss this channel can bear.

What are described above is related to the illustrative embodiments of the disclosure only and not limitative to the scope of the disclosure; the scopes of the disclosure are defined by the claims.

The invention claimed is:

1. An LED lamp driving method, comprising steps of:

S1: adjusting a correspondence relation between ports of LED lamps and channel ports of an LED lamp driving chip;

S2: storing the correspondence relation in a memory,

S3: controlling the correspondence between the ports of the LED lamps and the ports of the LED lamp driving chip by a switch controller according to output signals from a signal controller, S4: connecting the ports of the LED lamps and the channel ports of the LED lamp driving chip according to the adjusted correspondence relation to control light emission of the LED lamps, and S5: connecting the signal controller with a signal generator, the memory and the switch controller, respectively, and supplying power for the signal generator, the signal controller, the memory and the switch controller with a power supply.

2. The method of claim 1, wherein the step S1 includes modifying numberings of the ports of the LED lamps and numberings of the channel ports of the LED lamp driving chip in the correspondence relation according to an external trigger signal.

3. The method of claim 2, wherein the step S1 further includes adjusting the correspondence relation between the ports of LED lamps and the channel ports of the LED lamp driving chip when the maximum load of the LED lamp driving chip reaches a safety threshold.

4. The method of claim 3, wherein the safety threshold is a sum of forward conduction voltages of LEDs connected in series in a channel and a floating voltage in the channel.

5. The method of claim 4, wherein the floating voltage is 3V.

6. The method of claim 2, wherein the step S1 includes:

automatically adjusting the correspondence relation between the ports of the LED lamps and the channel ports of the LED lamp driving chip for every one clock period.

7. The method of claim 2, wherein the correspondence relation between the ports of the LED lamps and the channel ports of the LED lamp driving chip is adjusted based on a shift cycle method.

8. The method of a claim 1, wherein the correspondence relation between the ports of the LED lamps and the channel ports of the LED lamp driving chip is adjusted based on a shift cycle method.

9. An LED lamp driving system, the system comprising a plurality strings of LED lamps and at least one LED lamp driving chip, wherein the system further comprises a driving controller for controlling the correspondence relations between ports of the LED lamp and ports of the LED lamp driving chip, and wherein the LED lamp is connected with the driving controller, and the driving controller is connected with the LED lamp driving chip, wherein the driving controller comprises:

a signal generator, a signal controller for adjusting the correspondence relation according to signals sent from the signal generator, a memory for storing the correspondence relation;

a switch controller for controlling the correspondence relation between the ports of the LED lamps and the ports of the LED lamp driving chip according to output signals from the signal controller; and a power supply;

wherein the signal controller is connected with the signal generator, the memory and the switch controller, respectively, and the power supply supplies power for the signal generator, the signal controller, the memory and the switch controller.

10. The LED lamp driving system of claim 9, wherein the signal generator is a crystal oscillator.

11. The LED lamp driving system of claim 10, wherein the switch controller is a MOS circuit.

12. The LED lamp driving system of claim 10, wherein the switch controller is a switching circuit.

13. The LED lamp driving system of claim 9, wherein the signal generator is a timer counter.

* * * * *